US009700190B2

(12) United States Patent
Field

(10) Patent No.: US 9,700,190 B2
(45) Date of Patent: Jul. 11, 2017

(54) CLEANING DISC HAVING SACRIFICIAL ELECTROLYSIS CELL AND CORRESPONDING MOBILE FLOOR CLEANER

(71) Applicant: Tennant Company, Minneapolis, MN (US)

(72) Inventor: Bruce F. Field, Golden Valley, MN (US)

(73) Assignee: TENNANT COMPANY, Minneapolis, MN (US)

( * ) Notice: Subject to any disclaimer, the term of this patent is extended or adjusted under 35 U.S.C. 154(b) by 308 days.

(21) Appl. No.: 14/498,403

(22) Filed: Sep. 26, 2014

(65) Prior Publication Data

US 2015/0089753 A1 Apr. 2, 2015

Related U.S. Application Data

(60) Provisional application No. 61/884,787, filed on Sep. 30, 2013.

(51) Int. Cl.

| | |
|---|---|
| ***A46B 13/04*** | (2006.01) |
| ***A47L 11/283*** | (2006.01) |
| ***A46B 13/00*** | (2006.01) |
| ***A47L 11/40*** | (2006.01) |
| ***A47L 11/164*** | (2006.01) |
| ***A47L 11/30*** | (2006.01) |
| ***A47L 11/16*** | (2006.01) |
| ***A47L 11/162*** | (2006.01) |

(52) U.S. Cl.

CPC ..... *A47L 11/283* (2013.01); *A46B 13/008* (2013.01); *A46B 13/04* (2013.01); *A47L 11/161* (2013.01); *A47L 11/164* (2013.01); *A47L 11/1625* (2013.01); *A47L 11/302* (2013.01); *A47L 11/305* (2013.01); *A47L 11/4038* (2013.01); *A47L 11/4083* (2013.01); *Y10T 29/49815* (2015.01)

(58) Field of Classification Search

CPC ..... A46B 7/08; A46B 11/00; A46B 11/0072; A46B 13/00; A46B 13/008; A46B 13/02; A46B 13/04; A46B 15/00; A47L 13/22; A47L 13/225; A47L 13/23; A47L 13/26; A47L 11/03; A47L 11/145; A47L 11/161; A47L 11/1625; A47L 11/164; A47L 11/201; A47L 11/283; A47L 11/293; A47L 11/305; A47L 11/4038; A47L 11/4083; A47L 11/408

USPC ..... 15/320–322, 50.1–52, 98, 180, 230

See application file for complete search history.

(56) References Cited

U.S. PATENT DOCUMENTS

2011/0219555 A1 9/2011 Field et al.

FOREIGN PATENT DOCUMENTS

| | | | |
|---|---|---|---|
| EP | 2168604 | * | 3/2010 |
| GB | 1070397 | * | 6/1967 |

(Continued)

OTHER PUBLICATIONS

International Search Report and Written Opinion dated Nov. 25, 2014 for corresponding International Application No. PCT.US2014/057754, filed Sep. 26, 2014.

*Primary Examiner* — Mark Spisich

(74) *Attorney, Agent, or Firm* — David D. Brush; Westman, Champlin & Koehler, P.A.

(57) ABSTRACT

An apparatus is provided having a scrubbing disc that includes sacrificial electrodes of an electrolysis cell.

18 Claims, 8 Drawing Sheets

(56) References Cited

FOREIGN PATENT DOCUMENTS

| | | | |
|---|---|---|---|
| JP | 2002-66199 | * | 3/2002 |
| JP | 2005-6816 | * | 1/2005 |
| WO | 2007095094 A1 | | 8/2007 |

* cited by examiner

CLEANING DISC HAVING SACRIFICIAL ELECTROLYSIS CELL AND CORRESPONDING MOBILE FLOOR CLEANER

CROSS-REFERENCE TO RELATED APPLICATION

This application claims the benefit of U.S. Provisional Patent Application No. 61/884,787, filed 30 Sep. 2013, the content of which is hereby incorporated by reference in its entirety.

FIELD OF THE DISCLOSURE

An aspect of the present disclosure relates to a cleaning tool, such as a rotatable scrubbing member, for use in cleaning machines, such as mobile floor cleaners, and more particularly to a rotating scrubbing member incorporating electrodes of an electrolysis cell.

BACKGROUND

Floor cleaning in public, commercial, institutional and industrial buildings have led to the development of various specialized floor cleaning machines, such as hard and soft floor cleaning machines. These cleaning machines generally utilize a cleaning liquid dispensing system and a cleaning head to perform a floor cleaning operation.

The cleaning liquid dispensing system generally dispenses a cleaning liquid that includes water and a chemically based detergent. The detergent typically includes a solvent, a builder, and a surfactant. The cleaning head typically includes one or more disc-type scrubbing brushes, which may be located in front of, under or behind the floor cleaning machine. The scrubbing brushes typically include nylon bristles, pads or other fibers. The scrubbing brushes are motorized to rotate during cleaning operations. The rotation of the scrubbing brushes causes the brushes to scrub the surface being cleaned as they engage the surface.

While detergents increase cleaning effectiveness for a variety of different soil types, such as dirt and oils, these detergents also have a tendency to leave unwanted residue on the cleaned surface. Such residue can adversely affect the appearance of the surface and the tendency of the surface to re-soil. Additionally, the detergents may not be environmentally friendly. Some mobile floor cleaning machines have been fitted with electrolysis cells for producing an electrochemically-activated cleaning liquid by electrolyzing a feed liquid such as tap water.

Improved floor cleaning heads, mobile floor cleaners, and floor cleaning methods are desired for reducing the use of detergents cleaning operations, while maintaining the efficacy of the floor cleaning operation.

SUMMARY

An aspect of the present disclosure relates to an apparatus, which includes a scrubbing disc and an electrolysis cell attached to the scrubbing disc.

Another aspect of the present disclosure relates to a scrubbing disc including a backing having a front face, bristles attached to the front face, and first and second electrodes permanently attached to the backing. The electrodes are spaced from one another by a gap so as to form an electrolysis cell on the scrubbing disc. The electrolysis cell has a liquid inlet and a liquid outlet, which enable liquid flow through the electrolysis cell toward the bristles.

Another aspect of the present disclosure relates to an apparatus including a scrubbing disc and sacrificial electrodes of an electrolysis cell formed integrally to the scrubbing disc so as to form a unitary component part.

Another aspect of the present disclosure relates to a mobile floor cleaner. The cleaner includes, a frame, at least one wheel connected to the frame and enabling movement of the cleaner relative to a surface, a liquid source, a control circuit configured to generate a voltage potential, and a cleaning head. The cleaning head has a scrubbing disc that is rotatable relative to the cleaner in a plane parallel to the surface. The scrubbing disc includes an electrolysis cell that is rotatable with the scrubbing disc. The electrolysis cell is removable from the cleaner with removal of the scrubbing disc. The cleaner further includes a liquid flow path from the liquid source to the electrolysis cell and an electrical connection, which passes the voltage potential from the control electronics to the electrolysis cell.

Another aspect of the present disclosure relates to a mobile floor cleaner, which includes a liquid source, a cleaning head and a scrubbing member carried by the cleaning head. The scrubbing member is rotatable in a plane parallel to the surface and includes an electrolysis cell that is removable from the cleaner with removal of the scrubbing disc. A liquid flow path extends from the liquid source to the electrolysis cell.

Another aspect of the present disclosure relates to a method, which includes: removing a first scrubbing disc from a mobile floor cleaner, the first scrubbing disc comprising a first, sacrificial electrolysis cell; retaining a control circuit for the first electrolysis cell on the mobile floor cleaner during the step of removing; and after removing the first scrubbing disc, attaching a second scrubbing disc comprising a second sacrificial electrolysis cell to the mobile floor cleaner such that the second electrolysis cell becomes electrically connected to the control circuit.

This Summary is provided to introduce a selection of concepts in a simplified form that are further described below in the Detailed Description. This Summary is not indented to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

The following description of illustrative aspect of the present disclosure. Elements having the same or similar reference number correspond to the same or similar elements.

An aspect of the present disclosure relates to a cleaning tool, such as a rotatable scrubbing member, for a mobile floor cleaning machine that has a sacrificial electrolysis cell incorporated in the scrubbing member. In the example of a rotatable scrub brush, the electrolysis cell may be attached to or integrated within the scrubbing brush so that the cell rotates with the brush.

In one exemplary embodiment, when the electrolysis cell is incorporated in the scrubbing brush, at the point of liquid distribution to the surface being cleaned, the electrolyzed cleaning liquid produced by the cell has less time after production to deactivate prior to application to the surface being cleaned. Also, since such scrubbing brushes are often replaced at regular intervals, problems caused by scaling within the electrolysis cell due to prolonged use of the cell can be avoided. These problems can include blockage to liquid flow and reduced current through the liquid being passed through the cell. These problems can reduce the efficacy of the cleaning liquid produced by the cell. In an exemplary embodiment, the electrolysis cell is permanently mounted to and replaced with the worn scrub brush. Also, since the cell is located at the point of distribution, tubing and other small orifices downstream of the cell may be avoided, which further can reduce the effects of scaling. These technical effects are provided as examples only and are not required in all embodiments of the present disclosure.

Figure 1:
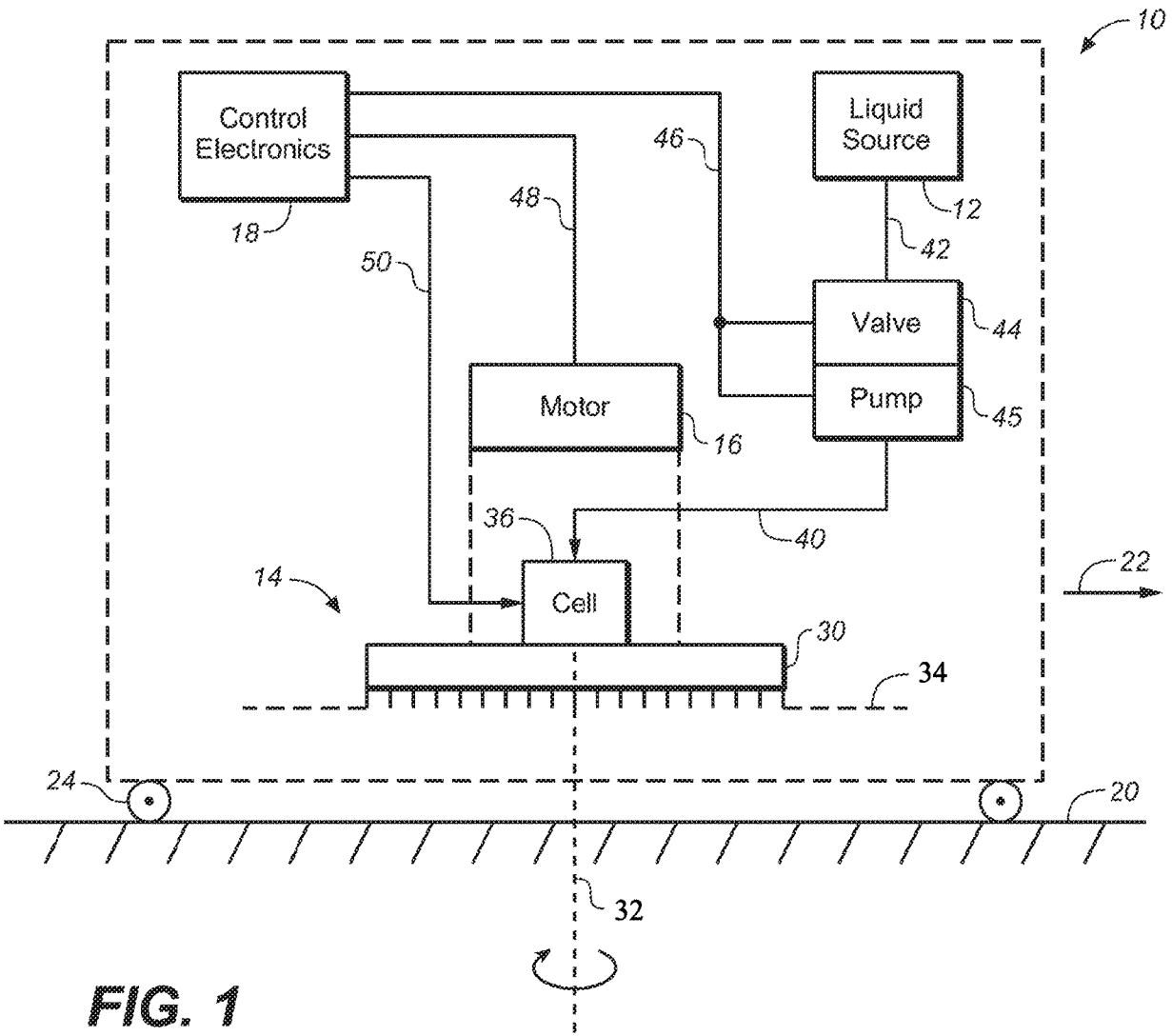
FIG. 1 is a simplified diagram of a mobile floor cleaner in accordance with an exemplary aspect of the present disclosure.

FIG. 1 is a simplified diagram of a mobile floor cleaner 10, in accordance with an exemplary aspect of the present disclosure. The mobile floor cleaner 10 may be designed for use by an operator that walks behind the machine or rides on the machine, for example. In another example, the mobile floor cleaner 10 may be designed to be towed behind a vehicle. During operation, mobile floor cleaner 10 advances along a surface 20 to be cleaned in a direction 22, using one or more wheels 24 carried by cleaner 10. In one embodiment, at least one of the wheels 24 is driven by a motor (not shown in FIG. 1) to propel the cleaner 10 in direction 22. The motor can also be configured to move the cleaner 10 in a direction that is opposite direction 22. Motors for propelling cleaner 10 can include, for example, an electric motor powered by an onboard power supply (e.g., one or more batteries) or through an electrical cord, and an internal combustion engine.

In this example, mobile floor cleaner 10 includes a liquid source 12, a cleaning head 14, a scrubbing member drive motor 16 and control electronics 18. Liquid source 12 can include a tank or other solution reservoir carried by the cleaner 10 for containing a feed liquid or can include a fitting or other inlet for receiving the feed liquid from an external source. In an embodiment, the feed liquid includes an aqueous composition, such as 1) regular, untreated tap water or other water that is commonly available, (2) pure water to which one or more electrolytes may be added, (3) chemically treated tap water, and (4) other aqueous solutions suitable for electrolysis.

Cleaning head 14 includes a disc-type scrubbing member, such as a scrubbing brush 30, which is rotated about an axis of rotation 32 by drive motor 16. In this example, axis of rotation 32 is perpendicular to the surface 20 being cleaned and a plane 34 defined by a face of scrubbing brush 30 that engages the surface 20. Thus, scrubbing brush 30 rotates within a plane 34 parallel to the surface 20 being cleaned.

The scrubbing brush 30 carries an electrolysis cell 36, such that the cell 36 rotates with scrubbing brush 30 when the brush is driven by motor 16. The electrolysis cell 36 may be permanently attached or removably attached to scrubbing brush 30. In one embodiment, the electrolysis cell is a sacrificial cell that is permanently attached to the scrubbing brush 30, and the elements of the cell are integrated within the scrubbing brush such that the brush and cell are fabricated together as a single, unitary part. However, the electrolysis cell 36 may be fabricated as a separate component part that is secured to the scrubbing brush 30.

Electrolysis cell 36 includes an inlet 40 for receiving the feed liquid from liquid source 12. The feed liquid can be supplied to electrolysis cell 36 through one or more tube(s) or other liquid conduit(s) 42. The liquid flow path from liquid source 12 to electrolysis cell 36 may include one or more valve(s) 44 and/or pump(s) 45 that are controlled by control electronics 18 through control lines 46 for supplying the feed liquid to the cell and brush during a cleaning operation. In another embodiment, the feed liquid is supplied from liquid source 12 by the operation of gravity, without a pump.

Control electronics 18 also controls operation of drive motor 16 through control lines 48 and controls electrolysis cell 36 through control lines 50. During a cleaning operation, control electronics 18 energizes drive motor 16 to rotate scrubbing brush 30 about axis 32, opens valve(s) 44, energizes pump 45 to supply the feed liquid to cleaning head, and energizes electrolysis cell 36 to electrolyze the feed liquid that passes through the cell.

Control electronics 18 energizes cell 36 by applying a suitable voltage across the electrodes contained in the cell. Since the cell 36 rotates with brush 30 relative to the body of the mobile floor cleaner 10, the control lines 50 may be connected to cell 36 though a contact connection or through a contact-less connection. For example, the connection between the control lines 50 and cell 36 may be made between electrical brushes and electrical contacts, which maintain electrical connection during rotation of the cell 36. In another example, the connection between the control lines 50 and cell 36 may be made through an inductive or other non-contact coupling.

Electrolysis cell 36 generates an electrolyzed cleaning liquid that is dispensed through the scrubbing brush 30 to the surface being cleaned. As the scrubbing brush rotates, the electrolyzed cleaning liquid distributes beneath the brush due to the centrifugal force created by rotation of the brush.

Brush drive motor 16 may be configured to rotate scrubbing brush 30 about axis 32 and/or agitate the scrubbing brush in any other movement, such as a lateral movement on one or more lateral directions.

Figure 2:
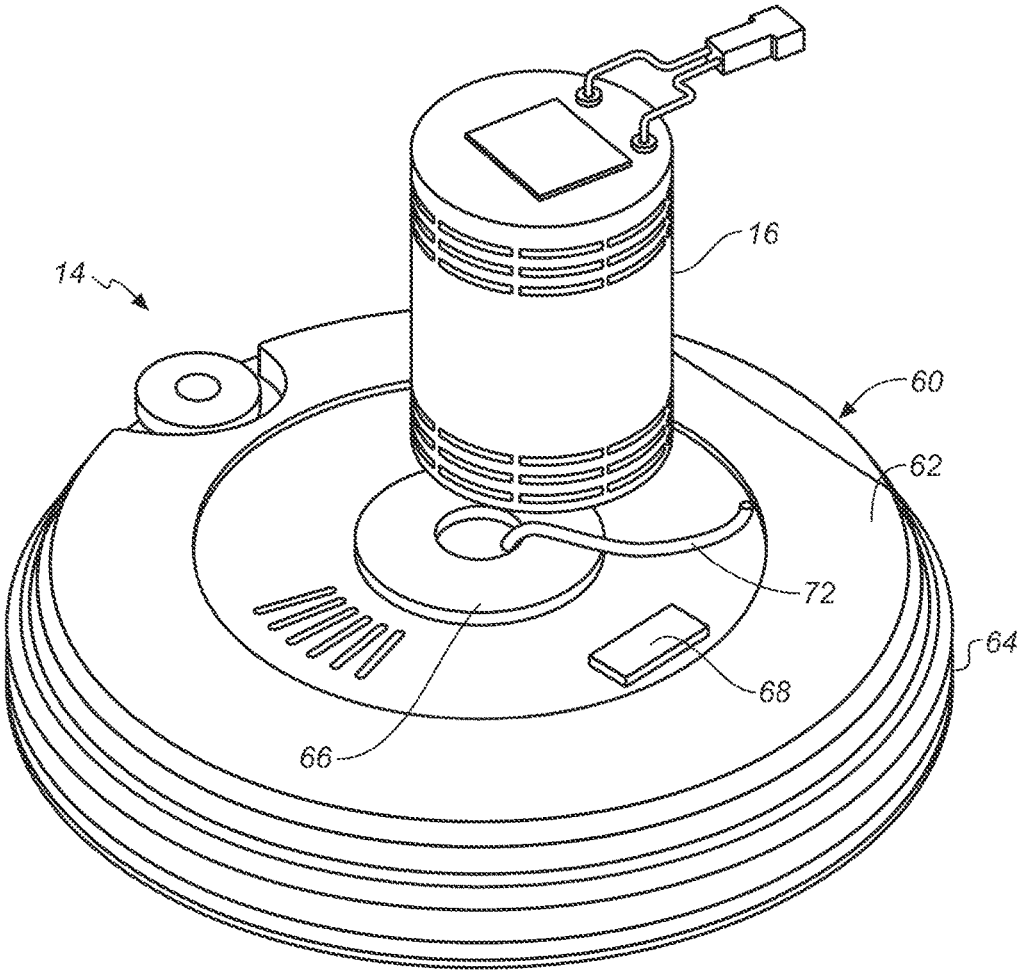
FIG. 2 is a perspective view of a particular example of a cleaning head in the mobile floor cleaner of FIG. 1.

FIG. 2 is a perspective view of a particular example of cleaning head 14. In this example, cleaning head 14 is designed to carry a single, disc-type scrubbing brush. Cleaning head 14 includes a stationary housing or shroud 60, often referred to as a casting, which is attached to the stationary part of brush motor 16. Shroud 60 has a substantially closed upper surface 62, and a substantially open lower surface 64 facing the surface to be cleaned. The scrubbing brush 30 is carried underneath the shroud 60 and is connected to the rotor of brush motor 16. Housing 60 has an aperture 66 at its center, for example, through the mechanical connection (not shown) between the rotor of motor 16 and scrubbing brush 30 passes.

In addition, cleaning head 14 includes a conduit 72 having a first end configured to be connected to the conduit 42 (shown in FIG. 1) for receiving the feed liquid from liquid source 12. A second end of conduit 72 passes through the aperture 66 to deliver the feed liquid to electrolysis cell 36 (not shown in FIG. 2) incorporated into the scrubbing brush 30. Shroud 60 further includes an electrical terminal block 68, which provides an electrical connection to the control lines 50 (FIG. 1) for controlling electrolysis cell 36. As explained in further detail below, shroud 60 also provides a connection from terminal block 68 to corresponding electrical conductors on scrubbing brush 30.

Figure 3:
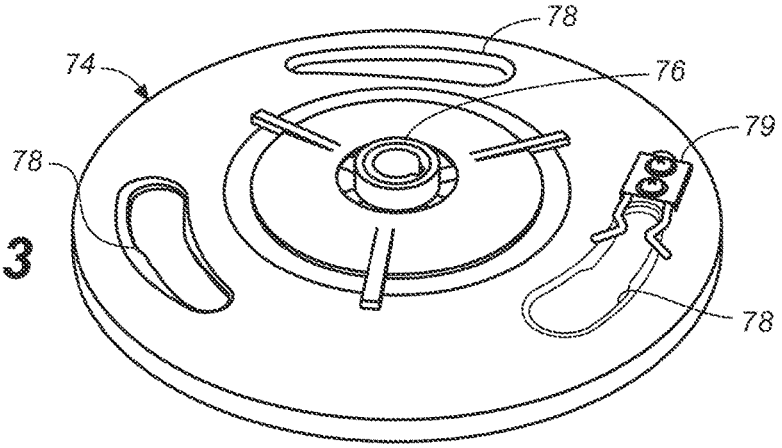
FIG. 3 is a perspective view of a disc hub receiver, which attaches a scrubbing member to the cleaning head of FIG. 2.

FIG. 3 is a perspective view of an adapter 74 (also known as a disc hub or receiver), which attaches the scrubbing brush 30 to the rotor of brush motor 16. Adapter 74 includes a central, female hub coupling 76, which is configured to receive and fixedly connect to the drive shaft of brush motor 16. The adapter 74 may be connected to the drive shaft by a bolt passing axially through the coupling or a set screw within hub 76, for example. Other methods of attachment may also be used. Adapter 74 further includes a plurality of slots 78 configured to receive corresponding studs or cleats attached to the upper, back surface of scrubbing brush 30, by a friction fit, for example. A retaining spring 79 may be provided to maintain the brush studs engaged within the slots 78.

Figure 4:
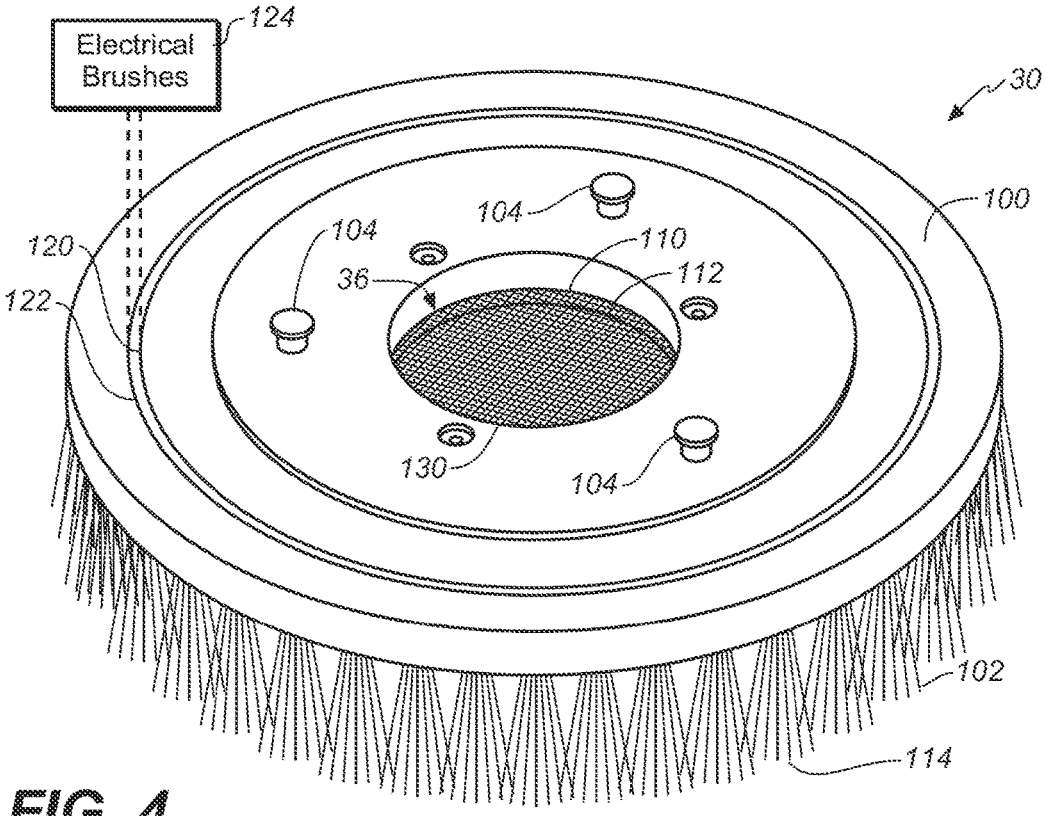
FIG. 4 is a perspective view of a scrubbing member according to a particular embodiment.

FIG. 4 is a perspective view of cleaning disc 30, such as a scrubbing brush, according to a particular embodiment. Scrubbing brush 30 is a disc-type brush including a backing 100, a set of bristles or other scrubbing material 102, a plurality of studs or cleats 104 (or other mechanical connection) and the electrolysis cell 36. As mentioned above, studs 104 pass through and frictionally engage slots 78 of adapter 74 (FIG. 3) to mount scrubbing brush 30 to adapter 74. Other structures for attachment may be used in other embodiments. The studs 104 form a mechanical connection configured to receive a rotating driving force through disc hub adapter 74 to rotate scrubbing brush 30.

Backing 100 can be formed of any suitable material such as plastic, synthetic material, wood, metal, etc. In a particular example, backing 100 is formed of a rigid plastic material through an injection molding processes. Bristles 102 may be attached in any suitable manner to the lower, front surface of backing 100. In one example, bristles 102 are molded within the backing material. Other methods attachments may be used such as adhesive. Bristles 102 can be made of any suitable material such as plastic, synthetic (e.g., nylon, Talkon, polyester, polypropylene filaments), natural animal hair (e.g. horse or hog hair), metal, abrasives, etc. Also, the bristles or filaments of the brush 30 may be generally aligned vertically as shown in FIG. 4 or may be interconnected or layered such as in a pad form.

Electrolysis cell 36 includes first and second electrodes 110 and 112, which in the example shown in FIG. 4, are arranged in parallel with and separated from one another by a suitable gap (electrode 112 lies beneath electrode 110 in FIG. 4 and is not directly visible in the figure). The electrodes 110 and 112 are electrically isolated from one another. Electrodes 110 and 112 are oriented in planes that are parallel to the face 114 of brush 30 that engages the surface being cleaned. In this example, electrodes 110 and 112 are molded within the material of backing 100, such that the backing, 100, bristles 102 and electrodes 110, 112 are fabricated as a single, unitary component part. As such, electrodes 110 and 112 are non-removable from scrubbing brush 30. The electrodes 110, 112 are sacrificial electrodes that are replaced with the scrubbing brush 30 when the scrubbing brush needs replacement. The potentially more expensive control electronics for controlling the voltages applied to the electrodes remain with the cleaning machine and are used with the replacement brush and electrodes. In another embodiment, electrolysis cell 36 is contained in its own housing, which is attached to scrubbing brush 30, such as on backing 100. Cell 36 can be attached removably or non-removably to scrubbing brush 30.

In the example shown in FIG. 4, the backing 100 has a disc shape with front and back surfaces, a center, and an aperture 130 located at the center and extending from the back surface to the front surface. The electrodes 110 and 112 positioned at the center of backing 100. Electrodes 110, 112 are planar, oriented parallel to the front and back surfaces and overlap the aperture 130. In this example, electrodes 110, 112 are mesh type electrodes, which enable water to pass through the aperture and the electrodes, from the back surface of backing 100 toward the front surface of backing 100 by the force of gravity.

Brush backing 100 includes and electrical coupling such as first and second electrical conductors, or contacts, 120, 122, which are electrically connected to electrodes 110, 112, respectively. In this example, electrical conductors 120, 122 are formed as coaxial, annular rings on backing 100. These rings are engaged by corresponding electrical brushes 124 carried by the lower surface of shroud 60 (FIG. 2) and connected to the terminal block 68. In another embodiment, the electrical conductors are carried by the shroud and the electrical brushes are carried by the scrubbing brush 30. As the scrubbing brush 30 rotates within shroud 60, the electrical brushes 124 maintain electrical contact with electrical conductors 120, 122. The conductors and brushes can be located at any radius on the upper surface of backing 100, along the periphery of backing 100, or anywhere on adapter 74, for example. In another embodiment, the electrical connection between terminal block 68 and electrodes 110, 112 is made by an inductive coupling, where a first portion of the coupling is attached to shroud 60 and a second portion of the coupling is attached to scrubbing brush 30 or adapter 74, for example. Other types of electrical couplings may be used in other embodiments.

During operation, control circuit 18 applies a suitable voltage potential across electrodes 110, 112, through control lines 50, terminal block 68, and conductors 120, 122. Feed liquid is supplied to cell 36 through conduit 42 (FIG. 1) and tubing 72 (FIG. 2). One end of tubing 72 extends through the aperture 66 in shroud 60 and directs the feed liquid to the central aperture 130 in brush backing 100. As scrubbing member drive motor 16 (FIGS. 1 and 2) rotates scrubbing brush 30 about axis 32, the feed liquid pours through aperture 130 and into electrolysis cell 36. In this example, electrodes 110 and 112 of cell 36 are made of a conductive metallic mesh. As the brush 30 rotates, the feed liquid passes though the mesh electrodes in a somewhat spiral direction, from the center of the electrodes to their peripheries, for example, due to centrifugal force. This disperses the feed liquid across the electrode surfaces and in the gap between the electrodes. As the feed liquid passes between the electrodes, the voltage potential applied to the electrodes 110, 112 induces an electrical current through the feed liquid contained in the gap and thereby produces an electrochemically activated cleaning solution. Due to gravity, the electrochemically-activated cleaning solution exits the electrolysis cell 36 by passing through the lower mesh electrode 112, for example, and dispenses to the surface being cleaned and the bristles 102 of brush 30. The mechanical action of the bristles and centrifugal force disperse the cleaning solution beneath the brush to thereby clean the surface beneath the brush. As explained in more detail below, the mobile floor cleaner 10 may further include a liquid recovery system for recovering the soiled cleaning solution from the surface being cleaned. In a particular example, the brush motor drives scrubbing brush 30 to rotate at 200 rpm-400 rpm (rotations per minute), such as 300 rpm.

After prolonged periods of use, the bristles 102 of scrubbing brush 30 may become worn. In such a case, the scrubbing brush 30 may be removed from the mobile floor cleaner 10 by rotating the brush 30 in a direction to disengage the studs 104 from spring clip 79 and release the studs from slots 78 of adapter 74 (FIG. 3). The worn brush 30 may then be replaced with a new, unworn brush. In the embodiment shown in FIGS. 1-4, electrolysis cell 36 is removed from mobile floor cleaner 10 and replaced with scrubbing brush 30. Since mechanical and electrical operation of many electrolysis cells can be negatively affected by scale build up within the cells after prolonged periods of use, such negative effects may be reduced by regular replacement with scrubbing brush 30. For example, a typical scrubbing brush might be replaced after 100 hours to 300 hours of use. This period of use may be less than the period of use in which scaling in electrolysis cell 36 may become significant. In addition, by eliminating any tubing or small orifices used to deliver the activated liquid, scaling within the cell itself and along the distribution path is significantly reduced. In the example of FIG. 4, the activated liquid simply passes through the cell electrodes and onto the surface being cleaned with minimal obstructions.

Another exemplary technical effect of incorporating the electrolysis cell 36 in the scrubbing brush 30, in an exemplary embodiment, is that the feed liquid is electrochemically activated very close to the point of use at the surface being cleaned, at the very end of the liquid flow path. This limits neutralization of the activated cleaning solution from the time at which the liquid is activated by the cell to the time at which the liquid contacts the surface being cleaned.

In the embodiment describe with reference to FIGS. 1-4, the control electronics responsible for driving the electrodes of the electrolysis cell are carried by the mobile cleaning machine, and the driving voltages are applied to the electrodes through the control lines 50. In another embodiment, the control electronics for driving the electrolysis cell are also incorporated into the scrubbing brush 30. For example the cell control electronics can be incorporated into an integrated circuit embedded in or mounted to the brush backing 100. In this example, the control lines 50 would carry the supply voltage for powering the control electronics. The control electronics 18 carried by the mobile cleaning machine may be configured to control the other functions of the cleaner and control the various operating states of the cell control electronics that are incorporated in the brush.

Figure 5:
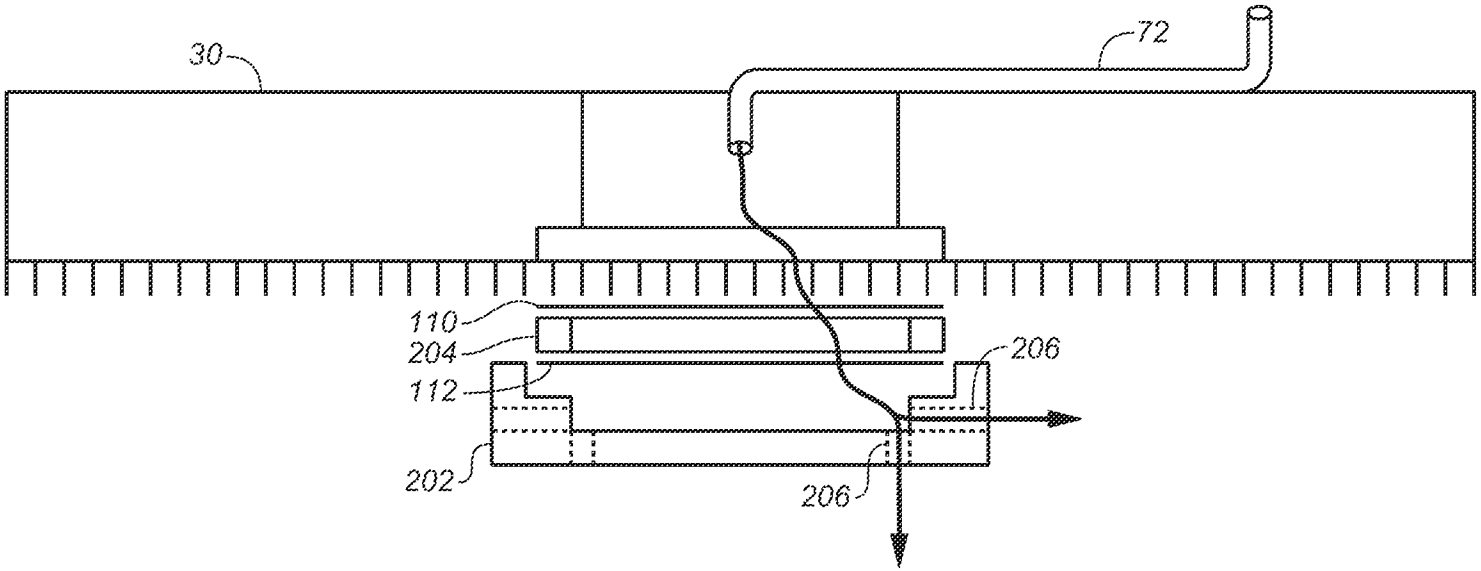
FIG. 5 is a schematic diagram illustrating a scrubbing member according to another embodiment of the disclosure.

FIG. 5 is a schematic diagram illustrating a scrubbing brush according to another embodiment of the disclosure. The same reference numerals are used for the same or similar elements. In this example, electrolysis cell further includes a bottom plate 202 and a spacer 204. Spacer 204 spaces the electrodes 110, 112 by the desired gap. Bottom plate 202 has one or more outlets 206 located along a peripheral wall of bottom plate 202 and/or along the bottom surface of the plate, such as near the periphery of the plate. The feed liquid passes through cell electrodes 110, 112 in a generally spiral direction as the cell 36 rotates with the scrubbing brush 30. The activated feed liquid then exits the cell 36 at the periphery of the cell, through outlet(s) 206. However, the outlets can be located at other locations, such as at the center of plate 202, or plate 202 may be perforated.

Figure 6:
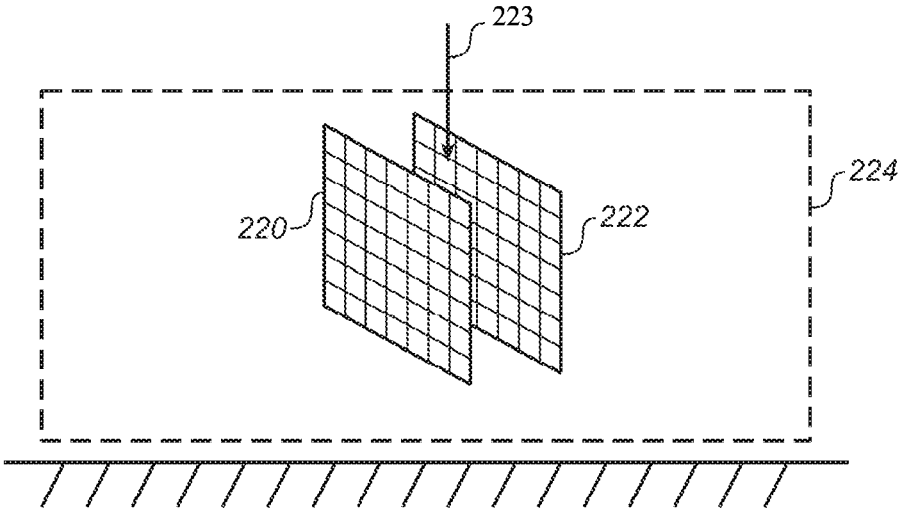
FIG. 6 illustrates a pair of planar electrodes oriented perpendicular to the surface being cleaned according to a particular embodiment.
Figure 7:
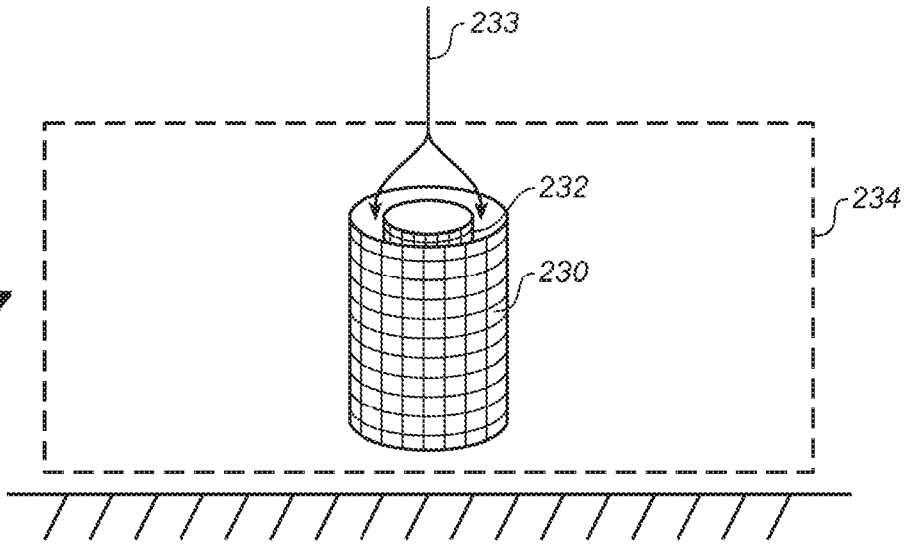
FIG. 7 illustrates a pair of cylindrical, coaxial electrodes oriented perpendicular to the surface being cleaned according to a particular embodiment.

The electrodes within the electrolysis cell 36 can have any suitable shape or orientation. In FIGS. 4 and 5, the electrodes are planar and oriented parallel to the surface being cleaned. FIG. 6 illustrates a pair of planar electrodes 220, 222 oriented perpendicular to the surface being cleaned where the feed liquid 223 passes along the gap between the electrodes. Electrodes 220, 222 are incorporated in scrubbing brush 224. FIG. 7 illustrates a pair of cylindrical, coaxial electrodes 230, 232 oriented perpendicular to the surface being cleaned where the feed liquid 233 passes along the gap between the electrodes. Electrodes 230, 232 are incorporated in scrubbing brush 234.

Referring back to FIG. 4, aperture 130 and thus the planar shape of electrodes 110, 112 are circular. Other shapes may be used in other embodiments, such as rectangular, oval, etc. Further, although a single aperture 130 is shown in FIG. 4, brush backing 100 could be formed with a plurality of apertures 130, each forming a channel through which the feed liquid may as it passes through electrodes 110, 112

Electrolysis cell 36 can include any fluid treatment cell that is adapted to apply an electric field across the fluid between at least one anode electrode and at least one cathode electrode. Electrolysis cell 36 can have any suitable number of electrodes, any suitable number of chambers for containing the fluid, and any suitable number of fluid inputs and fluid outputs. In the embodiment shown in FIG. 4, cell 36 has no membrane or other barrier (ion selective or non-ion-selection) between the electrodes. In another embodiment, the cell can include one or more membranes between the anode and cathode. Such a membrane can be ion selective or non-selective, such as a cation exchange membrane or an anion exchange membrane.

The electrodes 110, 112 can be made from any suitable material, such as a conductive polymer, titanium and/or titanium coated with a precious metal, such as platinum, or any other suitable electrode material. In one example, at least one of the anode or cathode is at least partially or wholly made from a conductive polymer. The electrodes can have any suitable shape and construction. For example, the electrodes can be flat plates, coaxial plates, rods, or a combination thereof. Each electrode can have, for example, a solid construction or can have one or more apertures. In one example, electrodes 110 and 112 are formed of a metallic mesh. In a specific example, one or both of the electrodes 110, 112 is formed of a metallic mesh with regular-sized rectangular openings in the form of a grid. In one specific example, the mesh is formed of 0.023-inch diameter T316 stainless steel having a grid pattern of 20×20 grid openings per square inch. However, other dimensions, arrangements and materials can be used in other examples. The electrodes 110, 112 may be separated by a gap such as but not limited to the range of 0.020 inches to 0.080 inches, such as a gap of 0.040 inches. In addition, multiple cells 36 can be coupled in series or in parallel with one another, for example.

In another embodiment, one or both of the electrodes are formed at least partially or wholly of a conductive polymer, such as those used for static dissipating devices. Examples of suitable conductive polymers are commercially available from RTP Company of Winona, Minn., USA. For example, the electrodes can be formed of a conductive plastic compound having a surface resistivity of $10^{0}$ to $10^{12}$ ohm/sq, such as $10^{1}$ to $10^{6}$ ohm/sq. However, electrodes having surface resistivities outside those ranges can be used in other examples.

With conductive polymer, the electrodes can be easily molded with or separately from the brush backing 100 or otherwise formed in any desired shape. For example, the electrodes can be injection molded. As mentioned above, one or more of the electrodes can form a mesh, with regular-sized rectangular openings in the form of a grid. However, the openings or apertures can have any shape, such as circular, triangular, curvilinear, rectilinear, regular and/or irregular. Curvilinear apertures have at least one curved edge. When injection molded, for example, the shapes and sizes of the apertures can be easily tailored to a particular pattern. However, these patterns can also be formed in metallic electrodes in other examples of the present disclosure. The apertures can be sized and positioned to increase the surface area of the electrode for electrolysis and thereby promote generation of gas bubbles in the liquid being treated.

As explained above, electrodes 110, 112 are electrically connected to opposite terminals of a power supply contained within control circuit 18. The power supply can provide a constant DC output voltage, a constant Ac output voltage, a pulsed or otherwise modulated DC output voltage, and/or a pulsed or otherwise modulated AC output voltage to the electrodes 110, 112. The power supply can have any suitable output voltage level, current level, duty cycle or waveform.

For example in one embodiment, the power supply applies the voltage supplied to the plates at a relative steady state. The power supply (and/or control electronics) includes a DC/DC converter that uses a pulse-width modulation (PWM) control scheme to control voltage and current output. Other types of power supplies can also be used, which can be pulsed or not pulsed and at other voltage and power ranges. The parameters are application-specific. In a particular example, the power supply applies a voltage in a range of about 5 volts (V) to about 40V across electrodes 110, 112. In a particular example, control electronics 18 applies a voltage of about 8 volts across the electrodes.

Cell 36 includes a reaction chamber between electrodes 110 and 112. The chamber can be defined by the walls of aperture 130 and the electrodes 110 and 112, for example. During operation, the feed liquid is supplied by liquid source 12 and introduced into the reaction chamber of electrolysis cell 36. In the embodiment shown in FIG. 4, electrolysis cell 36 does not include a membrane that separates reaction products at electrode 110 (e.g. anode electrode) from reaction products at electrode 112 (e.g. cathode electrode). In the example in which tap water is used as the liquid to be treated for use in cleaning, after introducing the water into the chamber and applying a voltage potential between electrodes 110 and 112, water molecules in contact with or near the anode are electrochemically oxidized to oxygen ($O_2$) and hydrogen ions ($H^+$) while water molecules in contact or near the cathode are electrochemically reduced to hydrogen gas ($H_2$) and hydroxyl ions ($OH^-$). Other reactions can also occur and the particular reactions depend on the components of the liquid. The reaction products from both electrodes are able to mix and form an electrochemically-activated, oxygenated cleaning solution (for example).

The electrolyzed cleaning disc described above can be implemented in a variety of different types of cleaning or sanitizing systems. For example, they can be implemented on an onboard (or off-board) mobile (or immobile) surface cleaner, such as a mobile hard floor surface cleaner, a mobile soft floor surface cleaner or a mobile surface cleaner that is adapted to clean both hard and soft floors or other surfaces, for example.

Figure 8A:
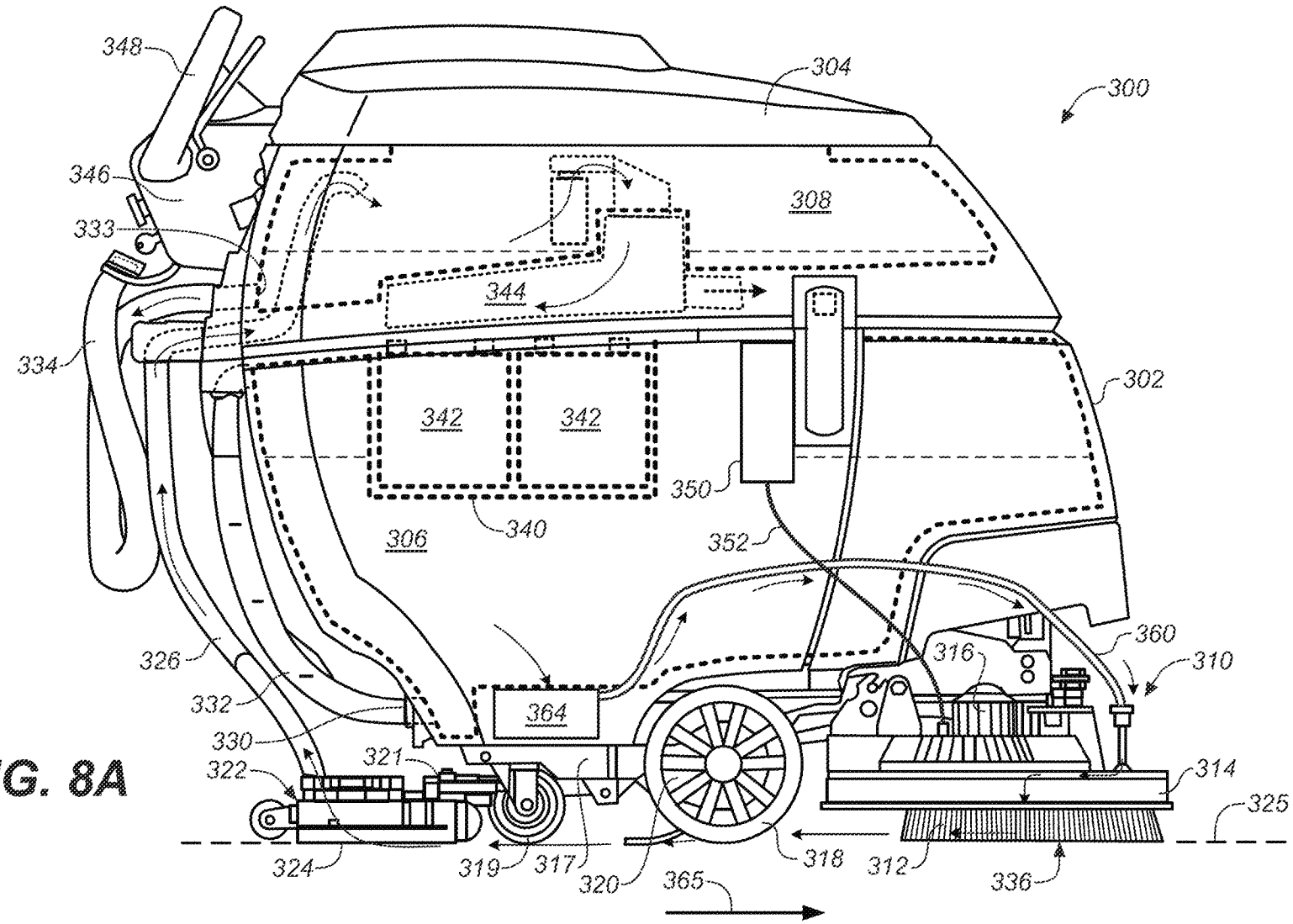
FIGS. 8A-8C illustrate a mobile floor surface cleaner in accordance with one or more exemplary embodiments of the present disclosure.
Figure 8B:
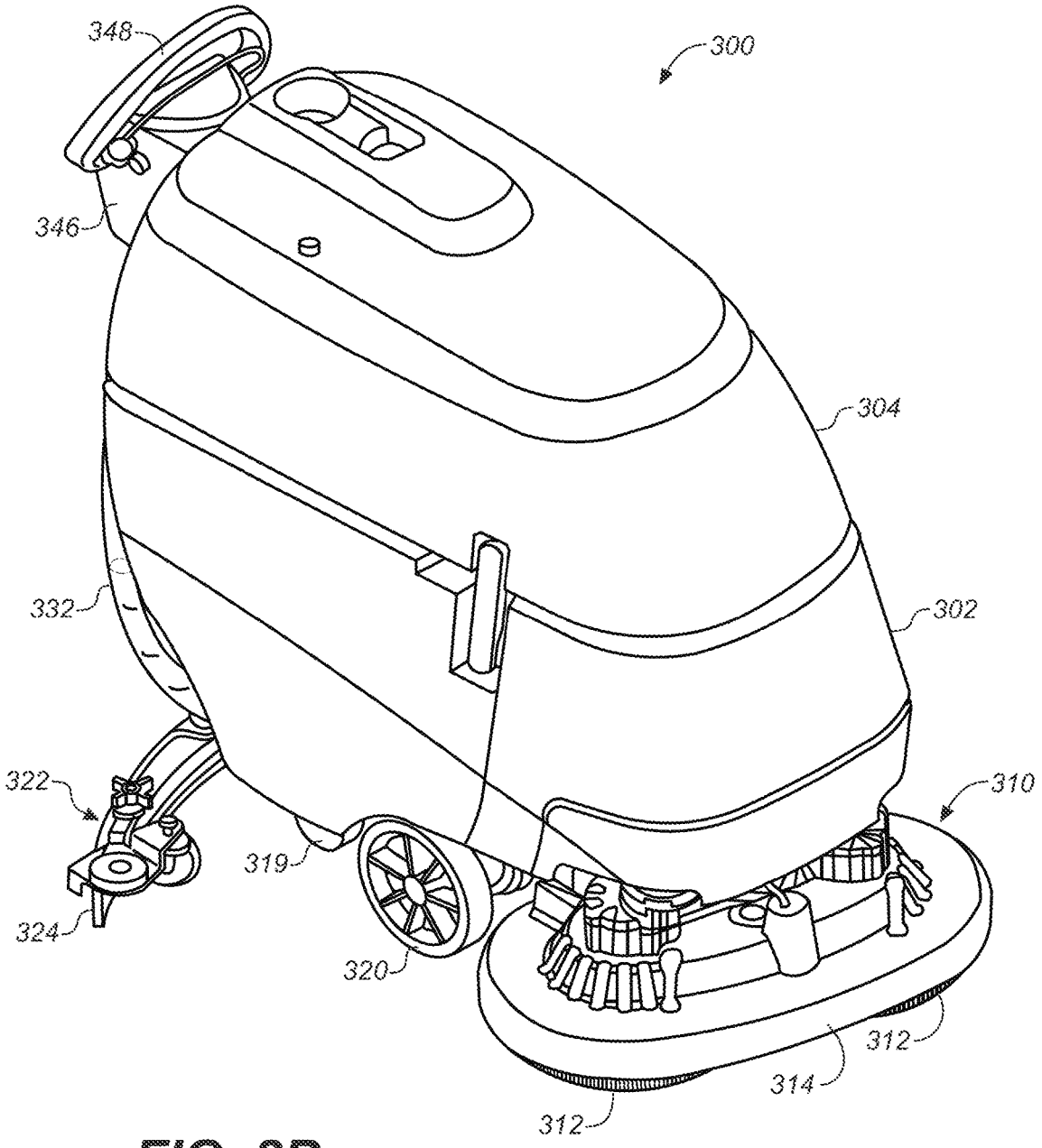
Figure 8C:
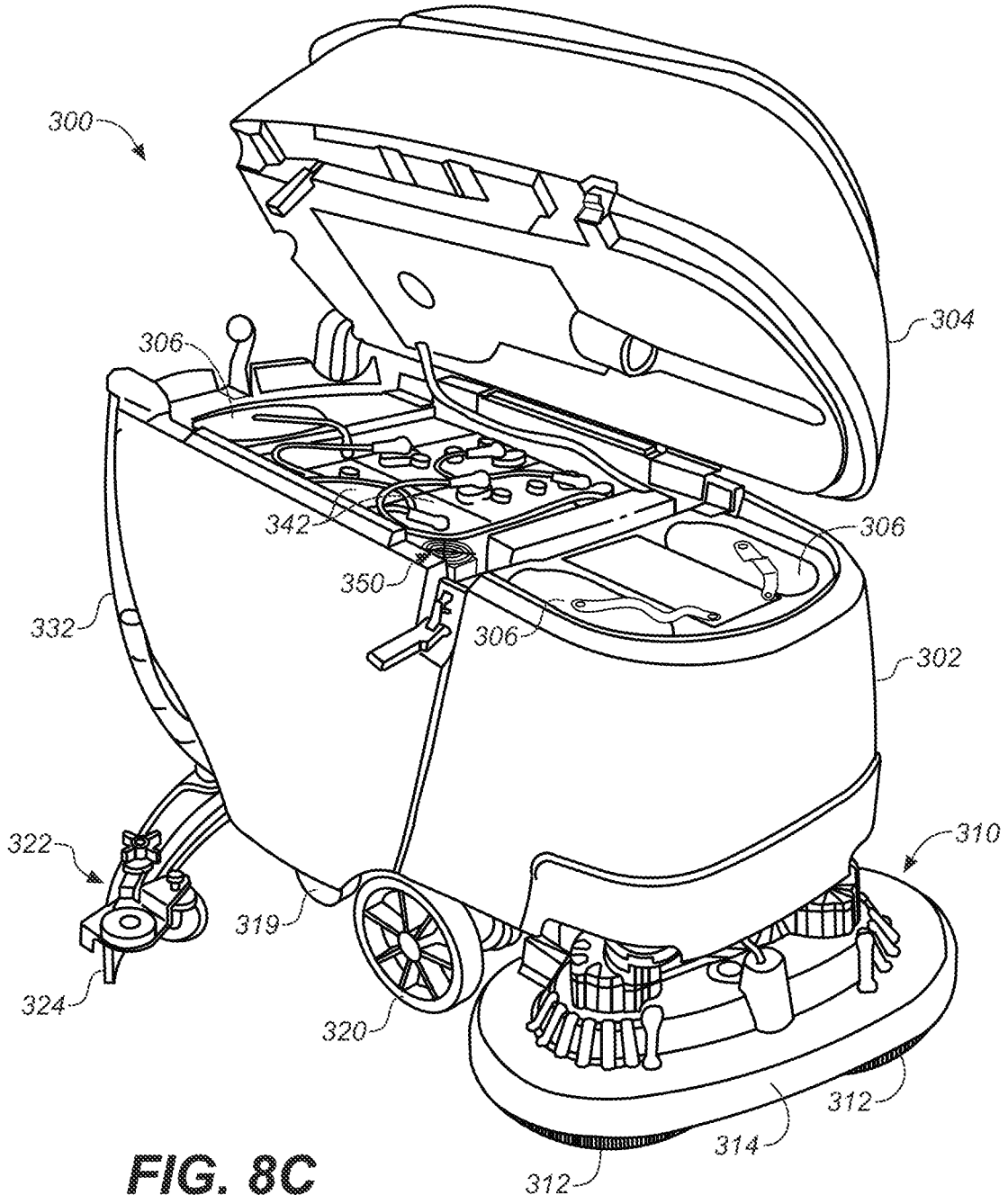

FIGS. 8A-8C illustrate a mobile floor surface cleaner 300 in accordance with one or more exemplary embodiments of the present disclosure. FIG. 8A is a side elevation view of cleaner 300. FIG. 8B is a perspective view of cleaner 300 having its lid in a closed position, and FIG. 8C is a perspective view of cleaner 300 having its lid in an open position.

In one example, cleaner 300 is similar to the Tennant T5 Walk-Behind Scrubber, which has been modified to include an electrolyzed cleaning disc (such as a scrubbing brush), such as but not limited to those shown in FIGS. 1-4 or any of the other embodiments shown or described herein and/or combinations thereof.

Cleaner 300 generally includes a base 302 and a lid 304, which is attached along one side of the base 302 by hinges (not shown) so that lid 304 can be pivoted up to provide access to the interior of base 302. Base 302 includes a tank 306 for containing a liquid or a primary cleaning and/or sanitizing liquid component (such as regular tap water) to be treated and applied to the floor surface during cleaning/sanitizing operations. Tank 306 can have any suitable shape within base 302, and can have compartments that at least partially surround other components carried by base 302.

Base 302 carries a motorized scrub head 310, which in this example includes two rotatable scrubbing members 312, a shroud 314, and a scrubbing member drive motor 316. Scrubbing member 312 may include one or more brushes, such as bristle brushes, pad scrubbers, microfibers, or other hard (or soft) floor surface scrubbing elements, for example. As explained above, scrubbing member 312 incorporates one or more electrolysis cells 336 (such as a cell similar to cell 36 shown in FIG. 4). Shroud 314 is similar to shroud 60 shown in FIG. 2 but is modified to shroud two scrubbing members instead of a single scrubbing member. Drive motor 316 includes one or more electric motors to rotate the scrubbing members 312. Scrubbing members 312 may include a disc-type scrub brush rotating about a generally vertical axis of rotation relative to the floor surface, as shown in FIGS. 8A-8C. Drive motor 316 may also oscillate scrubbing members 312 in a direction parallel to the floor. Scrub head 310 may be attached to cleaner 300 such that scrub head 310 can be moved between a lowered cleaning position and a raised traveling position.

Base 302 further includes a machine frame 317, which supports source tank 306 on wheels 318 and castors 319. Wheels 318 are driven by a motor and transaxle assembly, shown at 320. The rear of the frame carries a linkage 321 to which a fluid recovery device 322 is attached. In the embodiment of FIGS. 8A-8C, the fluid recovery device 322 includes a vacuum squeegee 324 that is in vacuum communication with an inlet chamber in recovery tank 308 through a hose 326. The bottom of source tank 306 includes a drain 330, which is coupled to a drain hose 332 for emptying source tank 306. Similarly, the bottom of recovery tank 308 includes a drain 333, which is coupled to a drain hose 334 for emptying recovery tank 308. Alternatively, for example, one or both of the source tank and recovery tank and related systems can be housed in or carried by a separate apparatus.

In a further exemplary embodiment, the fluid recovery device includes a non-vacuumized mechanical device for lifting the soiled solution away from the floor surface and conveying the soiled solution toward a collection tank or receptacle. The non-vacuumized mechanical device can include, for example, a plurality of wiping media such as pliable material elements, which are rotated into contact with the floor surface to engage and lift the soiled solution from the floor surface.

In another embodiment, cleaner 300 includes a wand sprayer and extractor or other attachment (not shown) that can be used to clean off-floor surfaces.

Cleaner 300 may further include a battery compartment 340 in which batteries 342 reside. Batteries 342 provide power to drive motor 316, vacuum fan or pump 344, and other electrical components of cleaner 300. Vacuum fan 344 is mounted in the lid 304. A control unit 346 mounted on the rear of the body of cleaner 300 includes steering control handles 348 and operating controls and gages for cleaner 300. Cleaner 300 includes control electronics 350 for controlling the operation of electrolysis cell 336. Control electronics 350 may be separate from control unit 346 or incorporated within control unit 346. Control electronics 350 operates as discussed above with respect to the embodiments of FIGS. 1-5, and supplies power to cell 336 through control lines 352.

Liquid tank 306 is filled with a liquid to be treated for cleaning and/or sanitizing use, such as regular tap water. In one embodiment, the liquid is free of any surfactant, detergent or other cleaning chemical. Cleaner 300 further includes an output fluid flow path 360, which includes a pump 364. Tank 306 and pump 364 can be positioned anywhere on cleaner 300. In this example, pump 364 is mounted beneath source tank 306 and pumps water from tank 306 along flow path 360 to the electrolysis cell within scrubbing member 312 and ultimately to floor 325, wherein recovery device 322 recovers the soiled liquid and returns it to recovery tank 308. The arrows in FIG. 8A illustrate the direction of liquid flow from tank 306, through flow path 360, to floor 325 and then from recovery device 322 to recovery tank 308. Alternatively, for example, pump 364 can be removed and the flow path 360 configured such that water passes along flow path 360 by the operation of gravity. Any suitable type or model of pump can be used. For example, pump 364 can include a SHURflo SLV10-AB41 diaphragm pump (available from SHURflo, LLC of Cypress California) having an open flow capacity of 1.0 gallons/minute (gpm). In this example, a pump having a small open flow capacity can be used since the flow path 360 in this example has little or no back pressure. When enabled, pump 364 can be controlled to pump at any suitable rate, such as at any rate greater than zero gpm and up to 1.0 gpm. For example the rate can be set to a predetermined rate or an adjustable rate within the range of 0.1 gpm to 1.0 gpm, such as 0.12 gpm. Larger rates can be achieved with larger pumps, if desired.

In one embodiment of the disclosure, the control unit 346 is configured to operate pump 364 and electrolysis cell 336 in an "on demand" fashion. Pump 364 is in an "off" state and electrolysis cell 336 is de-energized when cleaner 300 is at rest and not moving relative to the floor being cleaned. Control unit 346 switches pump 364 to an "on" state and energizes electrolysis cell 336 when cleaner 300 travels in a forward direction relative to the floor, as indicated by arrow 365. In the "on" state, pump 364 pumps water from tank 306 through flow path 360 to electrolysis cell 336 within scrub head 310. Thus, electrolysis cell 336 generates and delivers electrochemically-activated water "on demand".

As the water passes through electrolysis cell 336 within scrubbing member 312, the cell temporarily restructures the water by injecting nanobubbles into the water so that it becomes highly oxygenated. In upon exiting cell 336, the oxygenated water dispenses directly to the floor being cleaned, for example.

As cleaner 300 advances at a typical rate across the surface being cleaned, the residence time on the surface between distribution to the surface and then recovery by vacuum squeegee 324 is relatively short, such as about three seconds. In one example, the electrochemically-activated water maintains its electrochemically activated properties and does not neutralize until after the liquid has been recovered from the surface. This allows the advantageous properties of each liquid to be utilized during a common cleaning operation.

After recovery, the nanobubbles begin to diminish and the liquid begins to neutralize. Once neutralized, the electrochemical properties, including the pH, of the recovered, blended liquid reverts to those of regular tap water.

Control electronics 350 and electrolysis cell 336 can be powered by batteries 342 or by one or more separate power supplies that are powered by or independent of batteries 342 and adapted to provide the electrodes with the desired voltage and current levels in a desired waveform.

The liquid distribution path of cleaner 300 can also include, if desired, one or more filters for removing selected components or chemicals from the feed water to reduce residue left on the surface being cleaned.

An aspect of the present disclosure relates to an apparatus comprising:

a scrubbing disc; and an electrolysis cell attached to the scrubbing disc.

In a particular embodiment, the electrolysis cell is permanently attached to scrubbing disc.

In a particular embodiment, the electrolysis cell is removably attached to scrubbing disc.

In a particular embodiment, the scrubbing disc comprises:

a backing; and a scrubbing material attached to the backing.

In a particular embodiment, the electrolysis cell comprises first and second electrolysis electrodes molded within material forming the backing.

In a particular embodiment;

the backing has a disc shape with front and back surfaces, a center, and an aperture located at the center and extending from the back surface to the front surface; and the first and second electrodes are positioned at the center of the backing.

In a particular embodiment, the first and second electrodes are planar, oriented parallel to at least one of the front and back surfaces and overlap the aperture.

In a particular embodiment, the first and second electrodes are mesh electrodes, which enable water to pass through the aperture and the first and second electrodes, from the back surface toward the front surface by gravity.

In a particular embodiment, the scrubbing material comprises bristles molded within material forming the backing.

In a particular embodiment, the scrubbing disc comprises an electrical coupling, which is electrically connected to the electrolysis cell and configured to receive electrical power during agitation of the scrubbing disc relative to a cleaning device to which the scrubbing brush is configured for mounting.

In a particular embodiment, the electrical coupling comprises a coupling selected from the group consisting of:

an electrical brush-type coupling comprising at least one of a set of electrical brushes or a set of electrical traces carried by the scrubbing brush;

an inductive coupling comprising a first portion of the coupling carried by the scrubbing brush.

In a particular embodiment, the scrubbing brush comprises a mechanical connection configured to receive a rotating driving force to rotate the scrubbing brush.

Another aspect of the present disclosure relates to a scrubbing disc comprising:

a backing having a front face;

bristles attached to the front face; and first and second electrodes permanently attached to the backing and being spaced from one another by a gap so as to form an electrolysis cell on the scrubbing disc, the electrolysis cell having a liquid inlet and a liquid outlet, which enable liquid flow through the electrolysis cell toward the bristles.

In a particular embodiment, the first and second electrodes and the bristles are molded within material forming the backing.

Another aspect of the present disclosure relates to an apparatus comprising:

a scrubbing disc;

sacrificial electrodes of an electrolysis cell formed integrally to the scrubbing disc so as to form a unitary component part.

Another aspect of the present disclosure relates to a mobile floor cleaner comprising:

a frame;

at least one wheel connected to the frame and enabling movement of the cleaner relative to a surface;

a liquid source;

a control circuit configured to generate a voltage potential;

a cleaning head comprising a scrubbing disc that is rotatable relative to the cleaner in a plane parallel to the surface, wherein the scrubbing disc comprises an electrolysis cell that is rotatable with the scrubbing disc, wherein the electrolysis cell is removable from the cleaner with removal of the scrubbing disc;

a liquid flow path from the liquid source to the electrolysis cell; and an electrical connection, which passes the voltage potential from the control circuit to the electrolysis cell.

Another aspect of the present disclosure relates to a mobile floor cleaner comprising:

a liquid source;

a cleaning head;

a scrubbing member carried by the cleaning head, which is rotatable in a plane parallel to the surface and comprises an electrolysis cell that is removable from the cleaner with removal of the scrubbing disc; and a liquid flow path from the liquid source to the electrolysis cell.

Another aspect of the present disclosure relates to a method comprising:

removing a first scrubbing disc from a mobile floor cleaner, the first scrubbing disc comprising a first, sacrificial electrolysis cell;

retaining a control circuit for the first electrolysis cell on the mobile floor cleaner during the step of removing; and after removing the first scrubbing disc, attaching a second scrubbing disc comprising a second sacrificial electrolysis cell to the mobile floor cleaner such that the second electrolysis cell becomes electrically connected to the control circuit.

For the purposes of promoting an understanding of the principles of the present disclosure, reference has been made to the particular embodiments illustrated in the drawings, and specific language has been used to describe these embodiments. However, no limitation of the scope of the appended claims is intended by this specific language, and the appended claims should be construed to encompass all embodiments that would normally occur to one of ordinary skill in the art.

The embodiments herein may be described in terms of functional block components and various process steps. Such functional blocks, such as the control circuit for the electrolysis cell and/or the other control electronics aboard the cleaning machine may be realized by any number of hardware and/or software components that perform the specified functions. For example, the described embodiments may employ various integrated circuit components, e.g., memory elements, processing elements, logic elements, look-up tables, and the like, which may carry out a variety of functions under the control of one or more microprocessors or other control devices. Similarly, where the elements of the described embodiments are implemented using software programming or software elements may be implemented with any programming or scripting language such as C, C++, Java, assembler, or the like, with the various algorithms being implemented with any combination of data structures, objects, processes, routines or other programming elements. Functional aspects may be implemented in algorithms that execute on one or more processors. Furthermore, the embodiments of the disclosure could employ any number of conventional techniques for electronics configuration, signal processing and/or control, data processing and the like.

The particular implementations shown and described herein are illustrative examples and are not intended to otherwise limit the scope of the appended claims in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the subject matter of the appended claims unless the element is specifically described as "essential" or "critical".

The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. Expressions such as "at least one of," when preceding a list of elements, modify the entire list of elements and do not modify the individual elements of the list.

The use of the terms "a" and "an" and "the" and similar terms in the context of describing the embodiments of the disclosure (especially in the context of the following claims) should be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Finally, the steps of all methods described herein are performable in any suitable order unless otherwise indicated herein or otherwise clearly contradicted by context. The use of any and all examples, or exemplary language (e.g., "such as") provided herein, is intended merely to better illuminate the various exemplary embodiments of the disclosure and does not pose a limitation on the scope of the appended claims unless otherwise claimed. Numerous modifications and adaptations will be readily apparent to those skilled in this art without departing from the spirit and scope of the disclosure and/or the appended claims.

What is claimed is:

1. An apparatus comprising:

a scrubbing disc, which comprises a mechanical connection configured to receive a rotating driving force to rotate the scrubbing disc; and an electrolysis cell attached to the scrubbing disc.

2. The apparatus of claim 1, wherein the electrolysis cell is permanently attached and integral to scrubbing disc.

3. The apparatus of claim 1, wherein the electrolysis cell is removably attached to scrubbing disc.

4. The apparatus of claim 1, wherein the scrubbing disc comprises:

a backing; and a scrubbing material attached to the backing.

5. The apparatus of claim 4, wherein the electrolysis cell comprises first and second electrolysis electrodes molded within material forming the backing.

6. The apparatus of claim 4, wherein:

the backing has a disc shape with front and back surfaces, a center, and an aperture located at the center and extending from the back surface to the front surface; and the first and second electrodes are positioned at the center of the backing.

7. The apparatus of claim 6, wherein the first and second electrodes are planar, oriented parallel to at least one of the front and back surfaces and overlap the aperture.

8. The apparatus of claim 7, wherein the first and second electrodes are mesh electrodes, which enable water to pass through the aperture and the first and second electrodes, from the back surface toward the front surface by gravity.

9. The apparatus of claim 4, wherein the scrubbing material comprises bristles molded within material forming the backing.

10. The apparatus of claim 1, wherein the scrubbing disc comprises an electrical coupling, which is electrically connected to the electrolysis cell and configured to receive electrical power during agitation of the scrubbing disc relative to a cleaning device to which the scrubbing disc is configured for mounting.

11. The apparatus of claim 10, wherein the electrical coupling comprises a coupling selected from the group consisting of:

an electrical brush-type coupling comprising at least one of a set of electrical brushes or a set of electrical traces carried by the scrubbing disc;

an inductive coupling comprising a first portion of the coupling carried by the scrubbing disc.

12. A scrubbing disc comprising:

a backing having a front face;

bristles attached to the front face;

first and second electrodes permanently attached to the backing and being spaced from one another by a gap so as to form an electrolysis cell on the scrubbing disc, the electrolysis cell having a liquid inlet and a liquid outlet, which enable liquid flow through the electrolysis cell toward the bristles; and a mechanical connection configured to receive a rotating driving force to rotate the scrubbing disc.

13. The scrubbing disc of claim 12, wherein the first and second electrodes and the bristles are molded within material forming the backing.

14. An apparatus comprising:

a rotatable scrubbing disc having a front surface and a back surface; and sacrificial planar electrodes of an electrolysis cell formed integrally to the scrubbing disc so as to form a unitary component part, wherein the first and second electrodes are oriented parallel to at least one of the front or back surfaces.

15. A mobile floor cleaner, which is movable relative to a surface comprising:

a liquid source;

a cleaning head;

a scrubbing member carried by the cleaning head, which is rotatable in a plane parallel to the surface and comprises an electrolysis cell that is removable from the cleaner with removal of the scrubbing member; and a liquid flow path from the liquid source to the electrolysis cell.

16. The mobile floor cleaner of claim 15, further comprising:

a frame;

at least one wheel connected to the frame and enabling movement of the cleaner relative to the surface;

control electronics configured to generate a voltage potential; and an electrical connection, which passes the voltage potential from the control electronics to the electrolysis cell.

17. The mobile floor cleaner of claim 16, wherein the electrical connection comprises:

an electrical contact on the rotatable scrubbing member; and a stationary electrical brush, which maintains electrical connection with the electrical contact during rotation of the scrubbing member relative to the electrical brush.

18. A method comprising:

removing a first scrubbing disc from a mobile floor cleaner, the first scrubbing disc comprising a first, sacrificial electrolysis cell;

retaining a control circuit for the first electrolysis cell on the mobile floor cleaner during the step of removing; and after removing the first scrubbing disc, attaching a second scrubbing disc comprising a second sacrificial electrolysis cell to the mobile floor cleaner such that the second electrolysis cell becomes electrically connected to the control circuit.

* * * * *